United States Patent [19]

Yoshida

[11] 4,369,818

[45] Jan. 25, 1983

[54] WEFT YARN FEEDER

[75] Inventor: Tadahiro Yoshida, Fujisawa, Japan

[73] Assignee: Yoshida Kogyo K.K., Tokyo, Japan

[21] Appl. No.: 197,227

[22] Filed: Oct. 15, 1980

[30] Foreign Application Priority Data

Oct. 16, 1979 [JP] Japan ..... 54-143113[U]

[51] Int. Cl.[3] ..... D03D 47/36

[52] U.S. Cl. ..... 139/452; 242/47.09

[58] Field of Search ..... 139/452; 66/132 R; 242/47.01, 47.08, 47.09

[56] References Cited

U.S. PATENT DOCUMENTS

| | | | |
|---|---|---|---|
| 2,074,022 | 3/1937 | Oppenlaender | 242/47.09 |
| 3,243,975 | 4/1966 | Lawson et al. | 66/132 R |
| 3,416,742 | 12/1968 | Haninger | 242/47.09 |
| 4,278,112 | 7/1981 | Takahashi | 139/452 |

FOREIGN PATENT DOCUMENTS

| | | | |
|---|---|---|---|
| 556152 | 4/1957 | Belgium | 242/47.08 |
| 430603 | 2/1948 | Italy | 242/47.09 |

*Primary Examiner*—Henry Jaudon

*Attorney, Agent, or Firm*—Hill, Van Santen, Steadman, Chiara & Simpson

[57] ABSTRACT

A yarn feeder for use in shuttleless looms, comprising: a fixed shaft supported at only one end by a support; a sleeve angularly adjustably mounted on the fixed shaft, the sleeve having a longitudinally extending bore through which the fixed shaft extends, the axis of the longitudinal bore being inclined to the axis of the sleeve; a roller rotatably mounted on the sleeve concentrically thereof; a rotatable shaft disposed parallel to the fixed shaft; a spool mounted on the rotatable shaft for rotation therewith; and a bracket connecting the fixed shaft and the rotatable shaft at their free ends.

3 Claims, 6 Drawing Figures

WEFT YARN FEEDER

BACKGROUND OF THE INVENTION

1. Field of the Invention

The present invention relates to a weft yarn feeder for use in shuttleless looms such as needle looms.

2. Prior Art

A known yarn feeder comprises a spool mounted on a rotatable shaft and a roller rotatably mounted on a non-rotatable shaft. A yarn having entered the yarn feeder passes several times around both the spool and roller and then through a yarn guide eye disposed between the yarn feeder and a filling carrier. The non-rotatable shaft is adjustably supported on a support so as to be disposed at a desired diverging angle to the axis of the rotatable shaft to spiral the yarn away from the point where it enters the yarn feeder. However, the non-rotatable shaft and the rotatable shaft are cantilevered or supported at only one end and hence tend to be bent relatively to one another while the yarn is being fed therearound. With this arrangement a proper feeding operation is difficult to achieve.

Yet, to connect the two shafts at their free ends requires a plurality of brackets of different length; one for each setting of the non-rotatable shaft. Thus a suitable one of the brackets must be chosen and installed depending on the distance between the free ends of the two shafts, which is laborious and time-consuming.

SUMMARY OF THE INVENTION

It is therefore an object of the present invention to provide a weft yarn feeder in which a roller can be adjustably disposed at a desired diverging angle to the axis of a rotatable shaft (on which a spool is mounted) without shifting a non-rotatable shaft on which the roller is rotatably mounted, requiring only one bracket to connect the two shafts at their free ends for any setting of the roller.

According to the present invention, a weft yarn feeder comprises: a fixed shaft supported at only one end by a support; a sleeve angularly adjustably mounted on the fixed shaft, the sleeve having a longitudinal bore through which the fixed shaft extends, the axis of the longitudinal bore being inclined to the axis of the sleeve; a roller rotatably mounted on the sleeve concentrically thereof; a rotatable shaft disposed parallel to the fixed shaft; a spool mounted on the rotatable shaft for rotation therewith; and a bracket connecting the fixed and rotatable shafts at their free ends.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
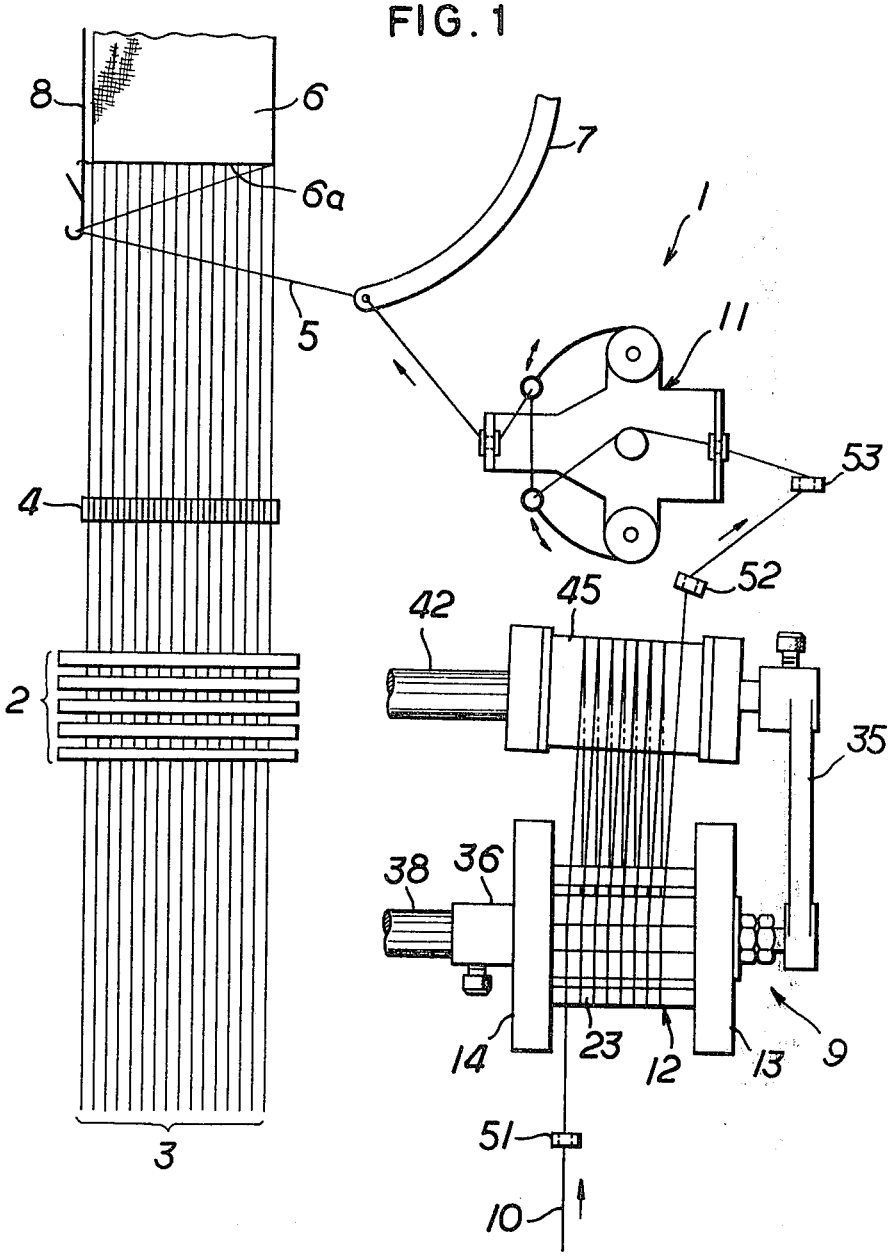
FIG. 1 is a schematic plan view of a needle loom in which a yarn feeder of the present invention is employed.

A weaving machine or loom 1 schematically illustrated in FIG. 1 generally comprises a plurality of heddles 2 for separating a plurality of warp yarns 3 to form warp sheds successively, a beat-up reed 4 movable back and forth to beat up an inserted filling 5 against the fell 6*a* of a narrow fabric 6 being produced, a filling carrier 7 pivotable to place a filling 5 across the warp shed, and a selvage-forming latch needle 8 reciprocable alongside of the fabric 6 for catching the knitting loops of fillings 5 with previous filling loops. The loom 1 also includes a weft yarn feeder 9 actuatable in synchronism with the operation of the filling carrier 7 for positively advancing a weft yarn 10, and a tension compensator 11 disposed between the filler carrier 7 and the weft yarn feeder 9 for keeping the weft yarn 10 under constant tension while the weft 10 is being supplied to the filling carrier 7.

Figure 2:
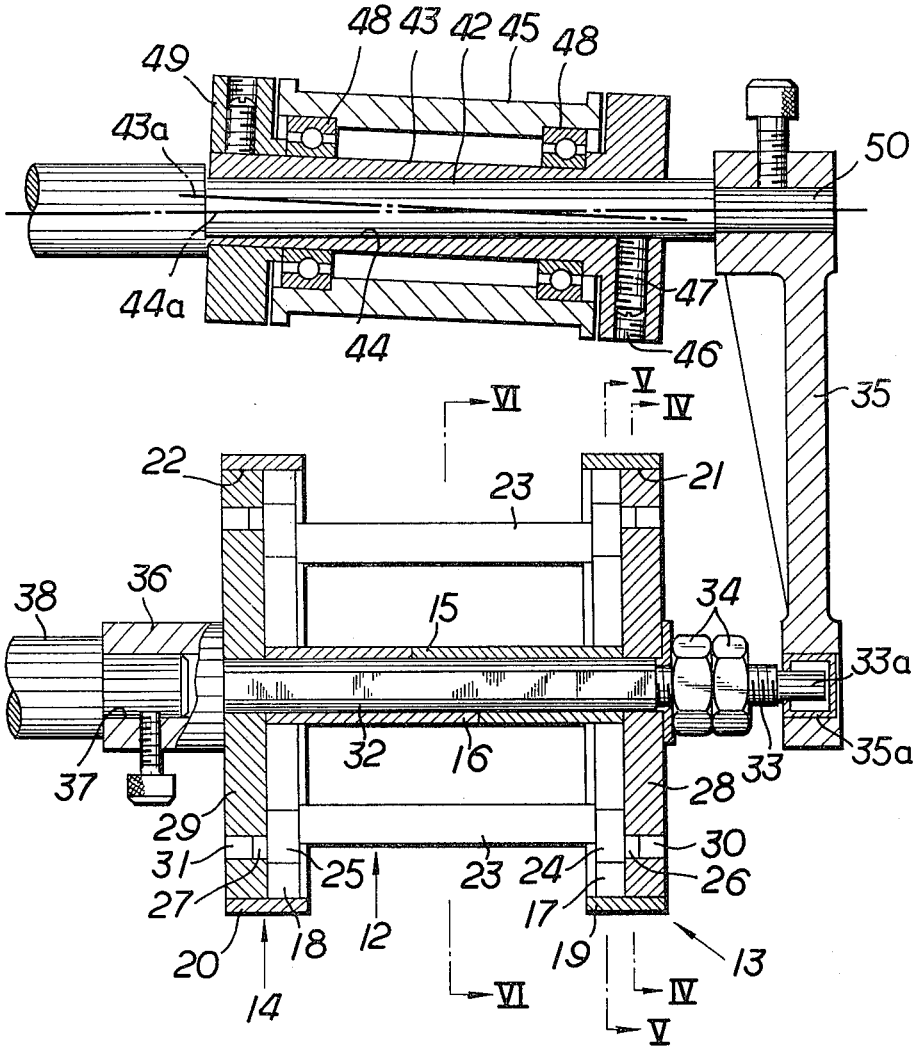
FIG. 2 is an enlarged longitudinal cross-sectional view of the yarn feeder.
Figure 3:
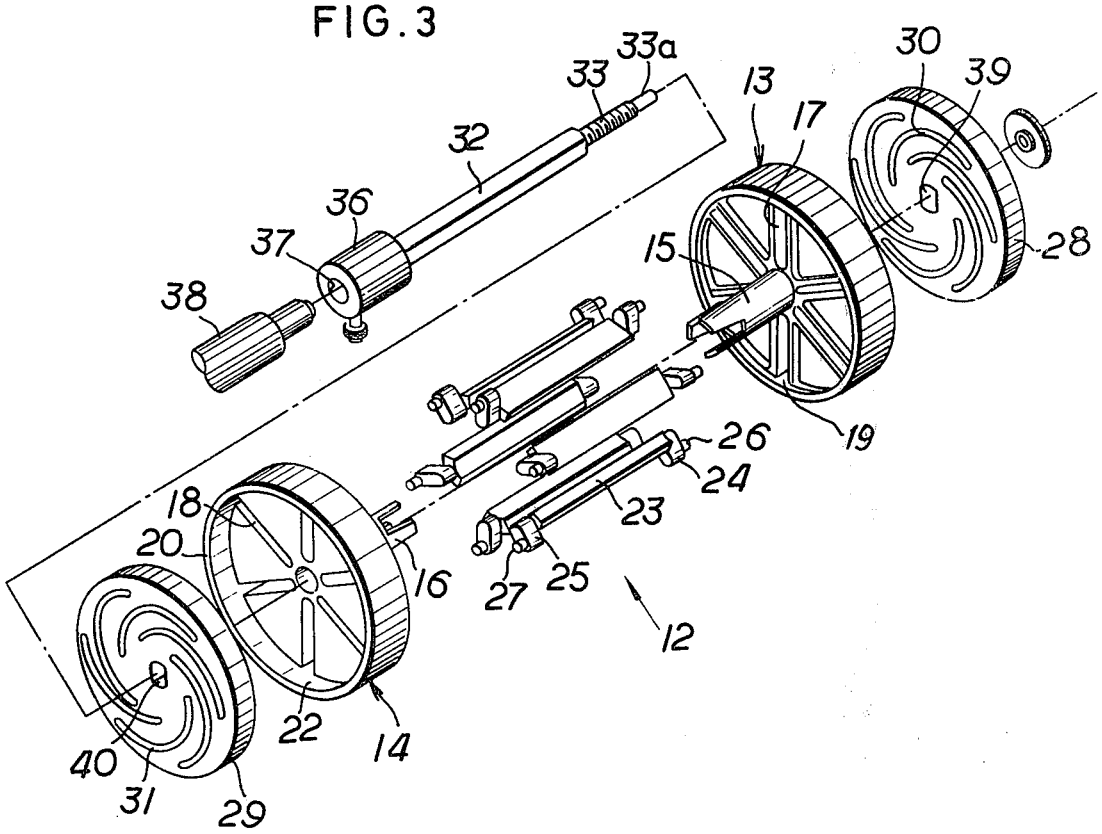
FIG. 3 is an exploded perspective view of a s

As shown in FIGS. 1 to 3, the weft yarn feeder 9 comprises a spool 12 including a pair of opposed detachable spool heads 13,14 each formed with an axial elongate tubular shaft member 15,16 (FIGS. 2 and 3). The tubular shaft members 15,16 are notched at their opposing distal ends so as to inter-engage with each other. The notches of the tubular member 15 are displaced angularly with respect to the notches of the tubular member 16 to permit the two members to inter-engage.

Each spool head 13,(14) is formed with a plurality of radial slots 17,(18) (FIGS. 2, 3, 5 and 6) angularly spaced equidistantly from one another and terminating at their outer ends adjacent to a flanged rim 19,(20) of the head 13,(14). The flanged rim 19,(20) forms in the outer portion of the head 12,(14) a circular cavity 21,(22), the purpose of which is described below. The radial slots 17 of the spool head 13 are angularly aligned about the spool axis with the radial slots 18 of the head 14 and are paired therewith.

Disposed between each opposing pair of radial slots 17,18 is an elongate member 23, shaped in cross-section (see FIG. 6) as an arcuate segment, which has at opposite ends a pair of end slides 24,25 radially slidably received in the slots 17,18, respectively. Each end slide 24,(25) is formed with a protruding pin 26,(27), for a purpose described below. The elongate members 23 are thus disposed circumferentially between the spool heads 13,14 and the axes of the members 23 are parallel to the common axis of the heads 13,14. Thus, outer convexly arcuate surfaces of the members 23 form a yarn-engaging surface.

A pair of discs 28,29 (FIG. 3) are disposed telescopically within the circular cavities 21,22, respectively, as shown in FIG. 2. Each disc 28,(29) has a plurality of arcuate guide slots 30,(31) (FIGS. 2 to 4) angularly spaced equidistantly from one another, into which the pins 26,(27) project and are movable therealong. The arcuate guide slots 30 in the disc 28 are angularly aligned about the spool axis with the arcuate guide slots 31 in the disc 29 and are paired therewith.

The entire spool structure 12, which includes the heads 13,14, the tubular members 15,16 and the elongate members 23, is mounted on a flat sided rotatable shaft or spindle 32 so as to be rotatable, as a unit, relative thereto. The spindle 32 has at one end a threaded portion 33 on which a pair of fastening nuts 34 are threaded, the threaded portion 33 projecting beyond the disc 28 and terminating in a smaller-diameter journal 33*a* rotatable in a bearing 35*a* carried by a bracket 35 (FIG. 2) at one end. The spindle 32 is non-rotatably held in place relatively to the disc 28 by tightening the fastening nuts 34 against the disc 28. An attachment block 36 (FIGS. 2 and 3) is formed at the other end of the spindle 32 and has an axial recess 37 for lockingly receiving a drive shaft 38 that is rotatable at a constant rate of speed. The discs 28,29 are formed with flat sided holes 39,40, respectively, which snugly engage the flat sided spindle 32 so that their opposing arcuate guide slots 30,31 are in register at all times.

Since the discs 28,29 are non-rotatably affixed relatively to the spindle 32 by the flat sided holes 39,40, the spool structure 12 composed of the heads 13,14, the tubular members 15,16 and the members 23 is rotatable with respect to the discs 28,29. Movement of the heads 13,14 relative to the spindle 32 and the discs 28,29 will cause the members 23 to contract or expand radially, depending on the direction of relative movement. Such expansion or contraction of the members 23 is caused by the displacement of the pins 26,27 in the arcuate guide slots 30,31, respectively, as the spool structure 12 is revolved about the spindle 32. The extent to which the members 23 expand or contract is determined by the extent to which the end slides 24,25 are moved in the radial slots 17,18. Thus the yarn engaging surface of the spool 12 can be expanded or contracted as desired, but at all times remain substantially cylindrical in shape.

Figure 4:
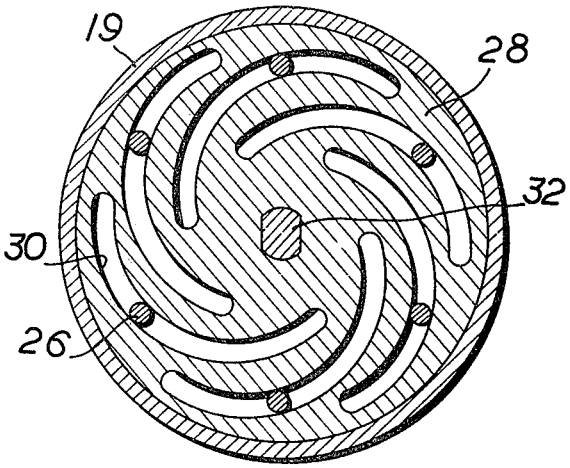
Figure 5:
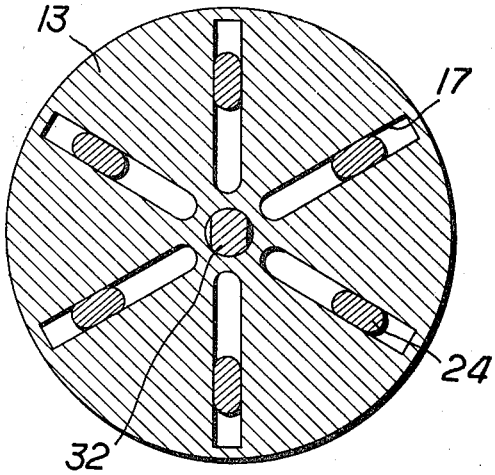
FIG. 5 is a cross-sectional view taken along line V—V of FIG. 2.
Figure 6:
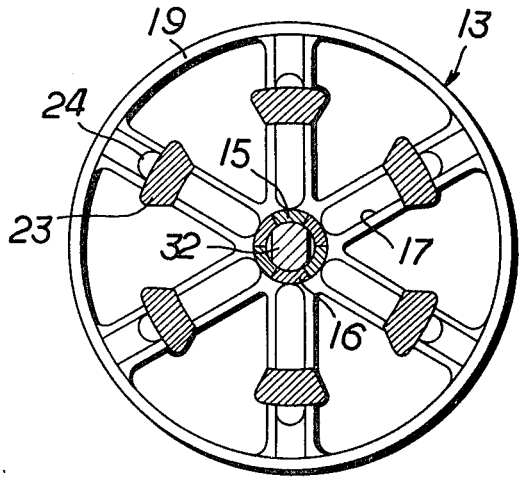
FIG. 6 is a cross-sectional view taken along line VI—VI of FIG. 2.

When it is necessary to change the rate of feed of the weft yarn 10, the spool heads 13,14 are turned about the spindle 32 relatively to the discs 28,29 after the fastening nuts 34 have been loosened. The end slides 24,25 are then moved radially outwardly or inwardly along the radial slots 17,18 (FIG. 5) as the pins 26,27 are moved along the arcuate guide slots 30,31 outwardly or inwardly of the discs 28,29 (FIG. 4). Accordingly, the diameter of the spool 12 around which the weft yarn 10 is to be wound as described below is changed to provide a different rate of feed of the weft yarn 10 while the spool 12 is being rotated at the same rate of speed.

Extending parallel to the spindle 32 and thus the axis of the spool 12 is a fixed shaft 42 (FIGS. 1 and 2) supported at only one end thereof by a support (not shown). As shown in FIG. 2, a sleeve 43 is angularly adjustably mounted on the fixed shaft 42 and has a longitudinally extending bore 44 through which the fixed shaft 42 extends, the axis 44*a* of the longitudinal bore 44 being inclined to the axis 43*a* of the sleeve 43. A roller 45 is rotatably mounted on the sleeve 43 concentrically thereof; that is, the roller 45 is disposed at a diverging angle to the axis of the spool 12 for a purpose described below.

The sleeve 43 has a radial threaded hole 46 through which a set screw 47 threadedly extends. The radial hole 46 communicates with the longitudinal bore 44 so that the set screw 47 is engageable with the fixed shaft 42 for holding the sleeve 43 in place on the fixed shaft 42. Disposed between the sleeve 43 and the roller 45 is a pair of axially spaced bearings 48,48. A stop collar 49 is detachably mounted on the sleeve 43 at one end.

The fixed shaft 42 projects beyond the other end of the sleeve 43 and terminates in a smaller-diameter end portion 50 to which the bracket 35 is detachably connected. The bracket 35 serves to prevent the fixed shaft 42 and spindle 32 from becoming bent relatively to one another.

As shown in FIG. 1, the weft yarn 10 enters the yarn feeder 9 through a first yarn guide eye 51 and is wound several times around the spool 12 and the roller 45, thence being fed to the filling carrier 7 through second and third yarn guide eyes 52,53 and the tension compensator 11. Since the roller 45 is disposed at a diverging angle to the axis of the spool 12, the weft yarn 10 is spiraled away from the point where it enters the yarn feeder 9, as is known in the art.

When it is necessary to change the angular position of the roller 45 relatively to the spool 12, the sleeve 43 is simply turned about the fixed shaft 42 after the set screw 47 has been loosened.

With this arrangement, the position of the roller 45 relative to the spool 12 can be changed without shifting the non-rotatable shaft 42 on which the roller 45 is mounted. It is therefore unnecessary to replace the bracket 35 by another which is different in length.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A yarn feeder comprising:
(a) a support;
(b) a fixed shaft supported at only one end thereof by said support;
(c) a sleeve angularly adjustably mounted in a selected fixed position on said fixed shaft, said sleeve having a longitudinal bore through which said fixed shaft extends, the axis of said longitudinal bore being inclined to the axis of said sleeve;
(d) a roller rotatably mounted on said sleeve concentrically thereof;
(e) a rotatable shaft disposed parallel to said fixed shaft;
(f) a spool mounted on said rotatable shaft for rotation therewith; and
(g) a bracket connecting said fixed shaft and said rotatable shaft at their free ends.

2. A yarn feeder according to claim 1, said sleeve having a radial hole through which a screw threadedly extends, said radial hole communicating with said longitudinal bore so that said screw is engageable with said fixed shaft to lock said fixed position, whereby said sleeve is allowed, by loosening said screw, to be angularly displaced about said fixed shaft for adjustment.

3. A yarn feeder according to claim 1, said spool having a variable diameter.

* * * * *